US005289939A

United States Patent [19]

Gordon et al.

[11] Patent Number: 5,289,939

[45] Date of Patent: Mar. 1, 1994

[54] GAS BARRIER FOLDING CARTON CONSTRUCTION

[75] Inventors: Robert L. Gordon, Monroe; David E. Stier, Middletown, both of N.Y.

[73] Assignee: International Paper Company, Purchase, N.Y.

[21] Appl. No.: 970,551

[22] Filed: Nov. 2, 1992

[51] Int. Cl.[5] ..... B65D 5/56

[52] U.S. Cl. ..... 220/462; 220/416; 229/132

[58] Field of Search ..... 220/416, 418, 461, 462, 220/463; 229/132, 133, 151

[56] References Cited

U.S. PATENT DOCUMENTS

| | | | |
|---|---|---|---|
| 1,517,964 | 12/1924 | Drysdale . | |
| 1,775,027 | 9/1930 | Hartmann . | |
| 1,907,067 | 5/1933 | Hartmann . | |
| 1,965,769 | 7/1934 | Kraft . | |
| 2,387,272 | 10/1945 | Klein . | |
| 2,542,298 | 2/1951 | Zinn . | |
| 2,568,382 | 9/1951 | Buckley . | |
| 2,599,708 | 6/1952 | Gottesman | 220/463 |
| 2,776,608 | 1/1957 | Fischer . | |
| 2,959,336 | 11/1960 | Mosse et al. | 220/462 |
| 3,071,304 | 1/1963 | Brastad . | |
| 3,114,300 | 12/1963 | Bianchi . | |
| 3,136,471 | 6/1964 | Brastad . | |
| 3,227,352 | 1/1966 | Ariplin et al. | 220/462 |
| 3,387,764 | 6/1968 | Forrest | 220/462 |
| 3,398,658 | 8/1968 | Jonson | 220/418 |
| 3,459,357 | 8/1969 | Egger et al. | 220/462 |
| 3,561,667 | 2/1971 | Saltman | 220/418 |
| 3,578,234 | 5/1971 | Marchisen | 220/418 |
| 3,987,711 | 10/1976 | Silver . | |
| 4,032,060 | 6/1977 | Bergstein | 220/462 |
| 4,171,064 | 10/1979 | Friess . | |
| 4,478,351 | 10/1984 | Homma | 220/463 |

FOREIGN PATENT DOCUMENTS

| | | | |
|---|---|---|---|
| 216955 | 1/1961 | Austria | 220/418 |
| 607386 | 8/1948 | United Kingdom | 220/418 |

*Primary Examiner*—Gary E. Elkins
*Attorney, Agent, or Firm*—Michael J. Doyle

[57] ABSTRACT

A gas barrier folding carton formed from a unitary paperboard blank (10) having a gas impermeable polymer layer (52) such as EVOH, nylon, or foil extruded on or laminated to one surface of the blank, except for certain abhesive (56, 58) coated areas. Two opposite side edges of the blank are seamed to form a flattened tube (13) having top and bottom closure flaps (30, 34, 36, 38, 40). One of the major closure flaps (36) at each top and bottom container end is provided with spaced abhesive areas (58), with areas of the two minor closure flaps (34, 38) also provided with abhesive (56). Upon folding the closure flaps at each end, the folding sequence pulls the barrier film (52) away from the abhesive (56, 58) areas and subsequent heat sealing produces hermetic sealing of the carton. This process and carton construction may be employed with conventional gas purging of the container interior by an inert gas before final sealing.

9 Claims, 5 Drawing Sheets

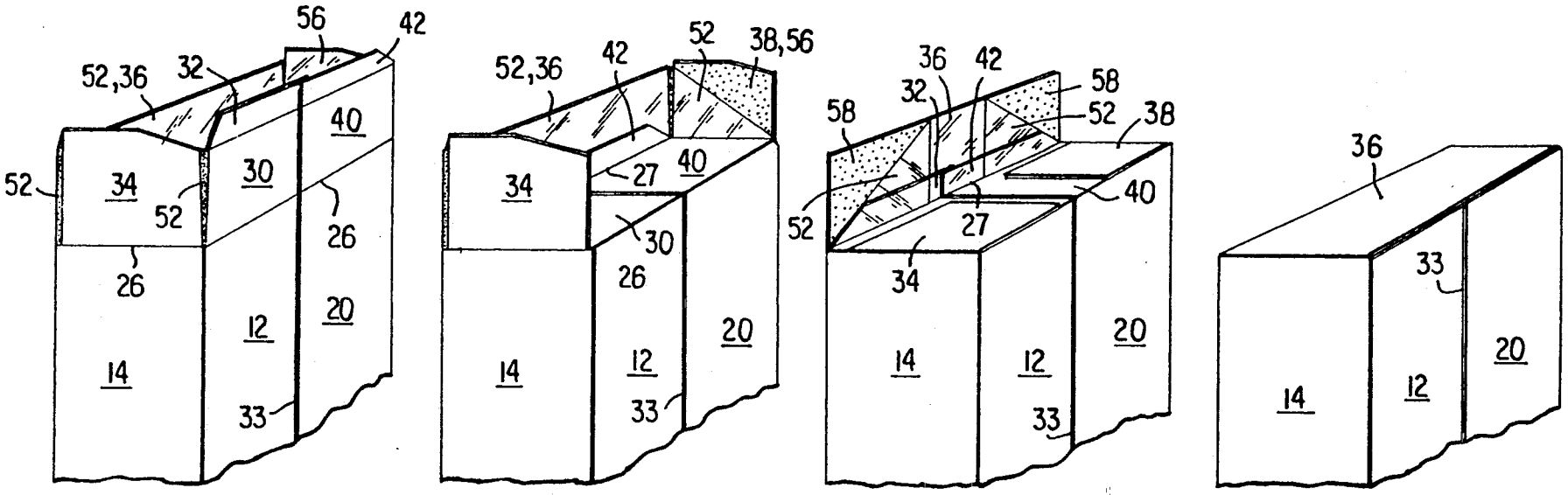
FIG. 10
FIG. 9
FIG. 8
FIG. 7
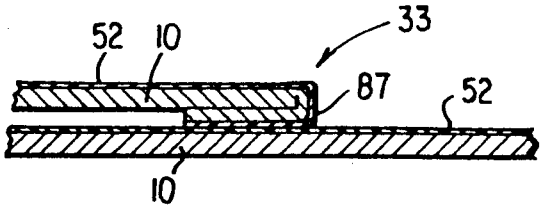
FIG. 11

GAS BARRIER FOLDING CARTON CONSTRUCTION

BACKGROUND OF THE INVENTION

This invention relates to paperboard containers and more particularly to a paperboard container provided interiorly with a polymer layer which functions as a barrier. The polymer layer is adhered to the interior surfaces of the container as by extrusion or by laminating.

It is known to provide paperboard cartons with plastic barrier liners. Such liners are usually adapted to inhibit or prevent sifting, as well as to prevent moisture or gas which penetrates through the paperboard from contacting the product in the container.

SUMMARY OF THE INVENTION

According to the practice of this invention, a novel lined paperboard blank and carton formed from it is provided by a particular configuration of the paperboard blank and polymer liner, together with specific abhesive portions between the interior forming surface of the blank and a barrier layer or liner. The manner of applying the barrier layer to the blank, and the manner of closing and sealing the carton yields a gas tight carton interior. This permits the carton contents, such as a food product, to be purged with an inert gas such as $CO_2$ or nitrogen to yield long shelf life of the packaged product. The nature of the product packaged determines the nature or composition of the barrier layer polymer, such a correspondence being known to those skilled in the packaging art.

BRIEF DESCRIPTION OF THE DRAWINGS

FIGS. 7 to 10 are partial perspective views of the upper end portion of a flattened container according to this invention, after it has been opened, filled with a product, and illustrates the carton top end closing and sealing sequence.

FIG. 11 is a view taken along section 11—11 of FIG. 6 and shows the container seam construction.

DETAILED DESCRIPTION OF THE INVENTION

Figure 1:
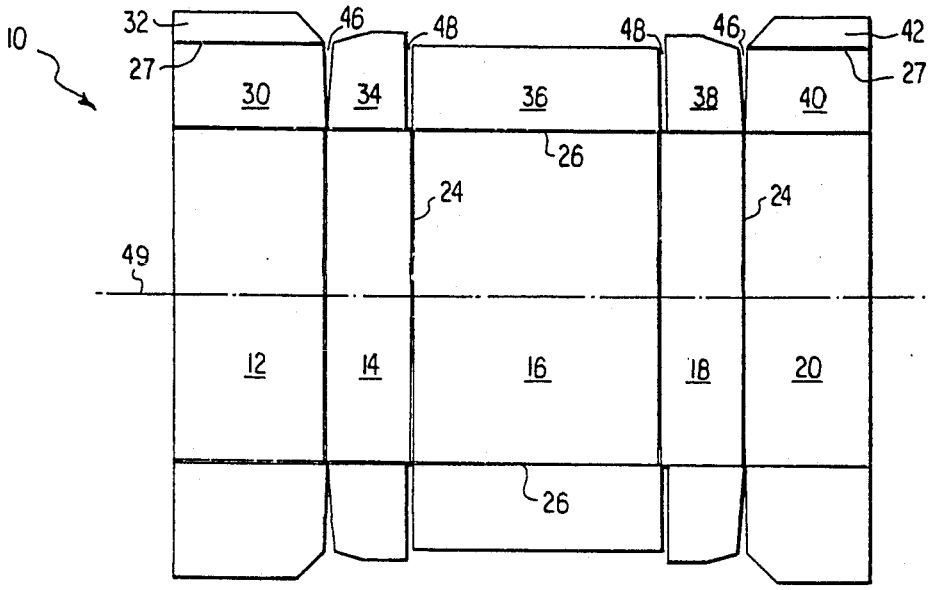
FIG. 1 is a plan view of a paperboard blank for forming the container of this invention.

Referring now to FIG. 1, the numeral 10 denotes generally a die cut unitary blank of paperboard. The blank includes five serially joined sidewall forming panels 12, 14, 16, 18, and 20 A plurality of vertically extending fold lines 24 and horizontally extending fold lines 26 divides the blank into side wall forming panels 12, 20, and 16, and end wall forming panels 14 and 18.

Each of a plurality of top end closure forming panels 30, 34, 36, 38, and 40 is foldably connected to its respective sidewall forming panel 12–20. Top closure forming panels 30 and 40 are provided with respective flaps 32 and 42 at their upper ends, flaps 32 and 42 joined to their respective panels by horizontal fold lines 27. Gaps 46 and 48 adjacent top end closure panels 34 and 38 separate them from their neighboring panel pairs 30, 36 and 36, 40. The blank exhibits mirror symmetry about a horizontal axis 49, and hence the bottom closure panels below this axis need not be described as they are the same as the top closure panels above the axis.

Figure 2:
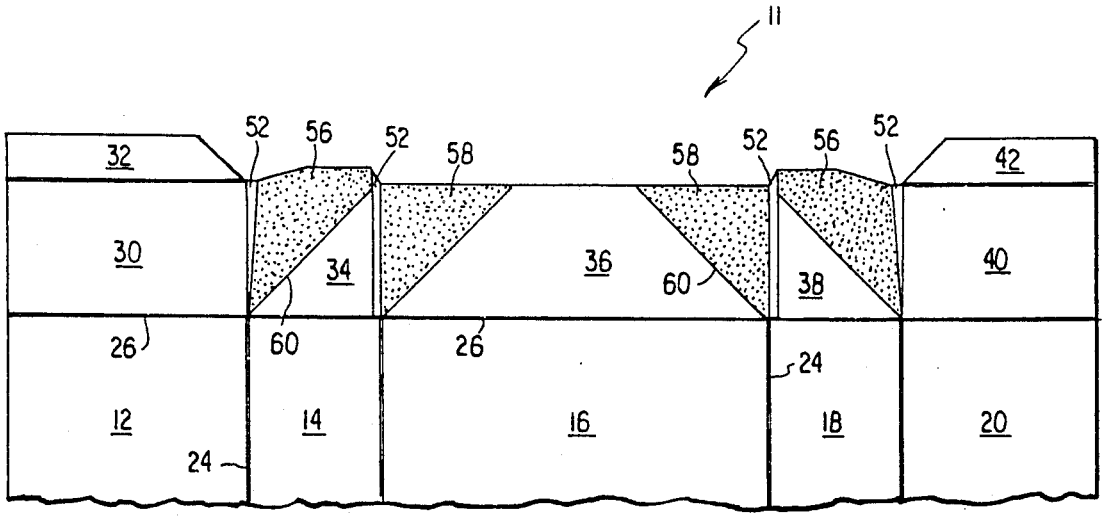
FIG. 2 is an enlarged view of the upper portion of the blank, after that surface of the blank nearest the reader (the interior forming surface of the container) has been provided with a gas barrier layer film and after some of the end closure panels of the blank have been provided in a certain pattern with an abhesive coating.

Referring now to FIG. 2, the blank 10 of FIG. 1 has been provided with a polymer layer 52 on its inside surface which functions as a gas barrier layer for a completed container. That surface of blank 10 which faces the reader is provided with the gas barrier polymer layer 52. Triangular sectors 56 on panels 34 and 38 are coated with an abhesive as are two such triangular sectors 58 at the ends of panel 36. Polymer barrier layer 52 covers and spans gaps 46 and 48 between neighboring upper end closure panels. It will be understood that the lower end closure panels are also provided with the same barrier layer 52 and abhesive patterns. The abhesive coatings on sectors 56 and 58 of FIG. 2 are stippled, while the polymer layer 52 which spans gaps 46 and 48 is shown clear. In FIGS. 7 and 8, the polymer layer 52 is shown as stippled so as to clearly delineate the gaps 46 and 48.

One manner of automated production of completed blanks such as shown at FIG. 2 will now be given.

Figure 3:
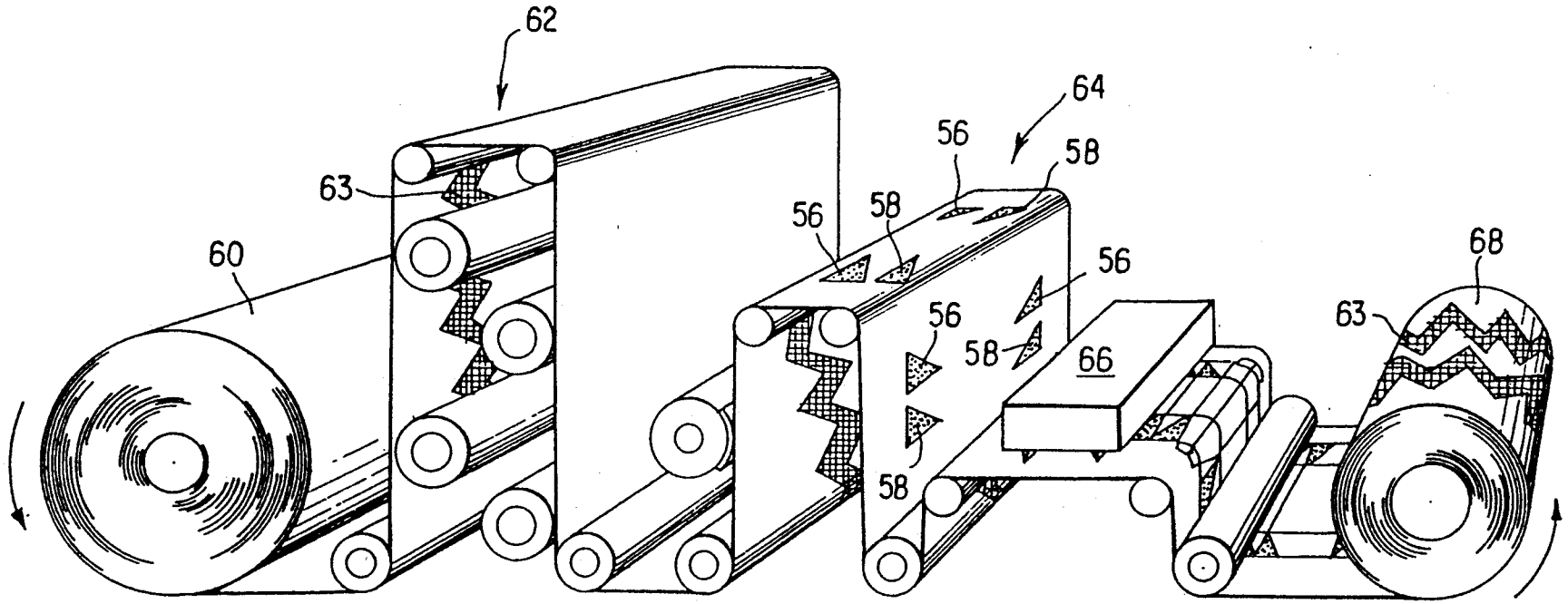
FIG. 3 is a partially schematic perspective illustrating a first step in forming the blank of FIG. 2, according to one method.

Referring now to FIG. 3 of the drawings, the numeral 60 denotes a rolled web of paperboard which is caused to rotate in the indicated direction to pass over a plurality of printing rollers at a station designated by 62 to provide graphics on the outside surface of the web, the graphics schematically designated as 63. From station 62, the web passes over rollers to station 64 where the other surface thereof is provided with spaced triangular patterns 56, 58 of abhesive, these being the abhesive coatings shown at FIG. 2. From station 64, the web passes to a die cutting and scoring station 66 where the web is die cut to define gaps 46 and 48 as shown at FIG. 1, and is also provided with score or fold lines 24, 26, and 27. The web is then wound to form a rolled web 68 which turns in the indicated direction. It will be understood that the individual mechanisms or apparatus for providing the described functions of stations 62, 64, and 66 are known in this art and form no part of the invention.

Figure 4:
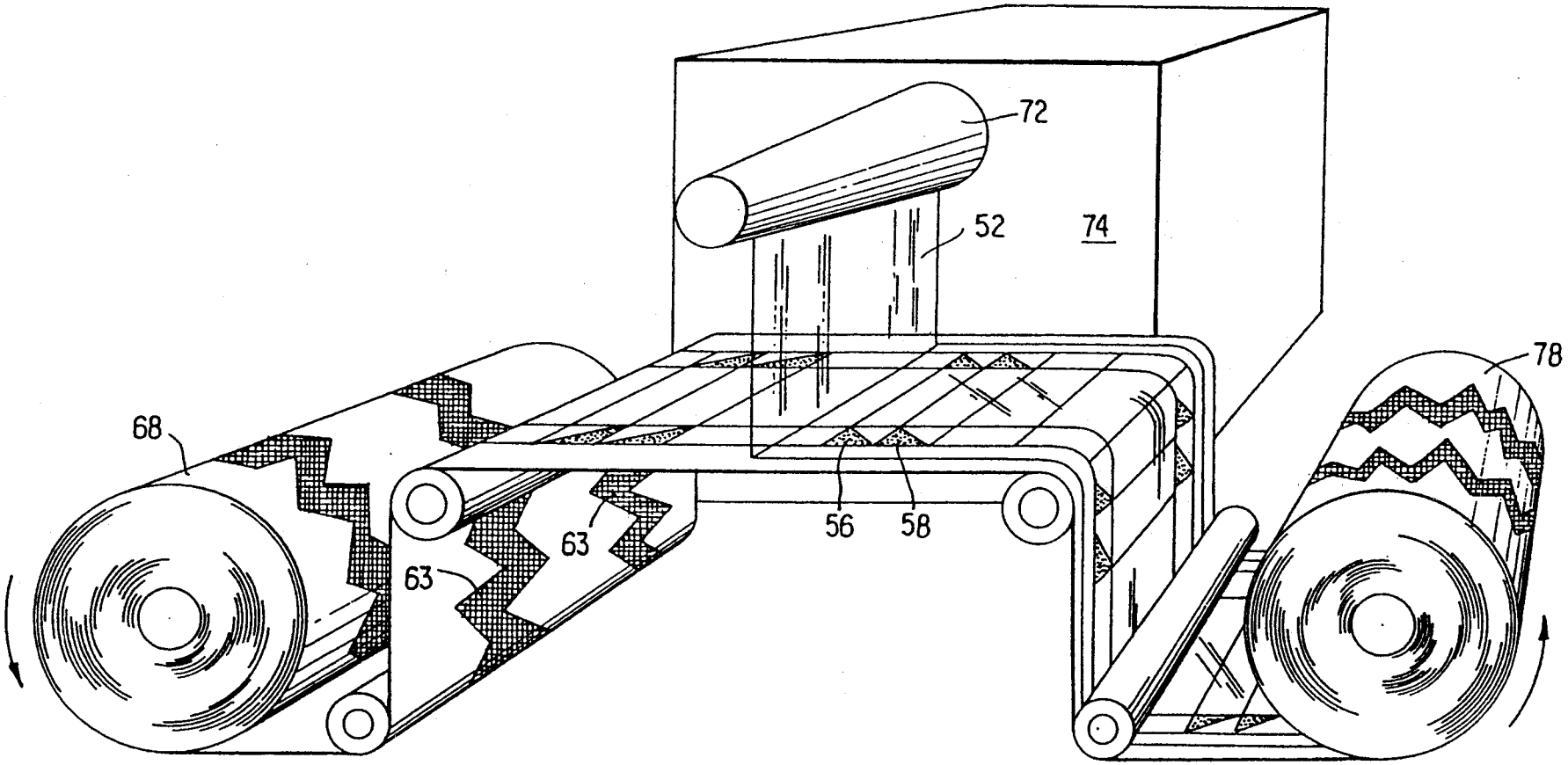
FIG. 4 is a view similar to FIG. 3, and showing a later stage in the production of the blank of FIG. 2.

FIG. 4 schematically illustrates the application of polymer barrier layer film 52 to web 68 of FIG. 3. The web is unwound by turning, with the web passing over rollers to receive barrier layer 52 from dispenser 72, the latter attached to base 74. Elements 72, 74 schematically designate either an extruder or laminator mechanism or apparatus, both of known construction. The coated web is now wound up to a roll 78 after passing over other rollers.

Figure 5:
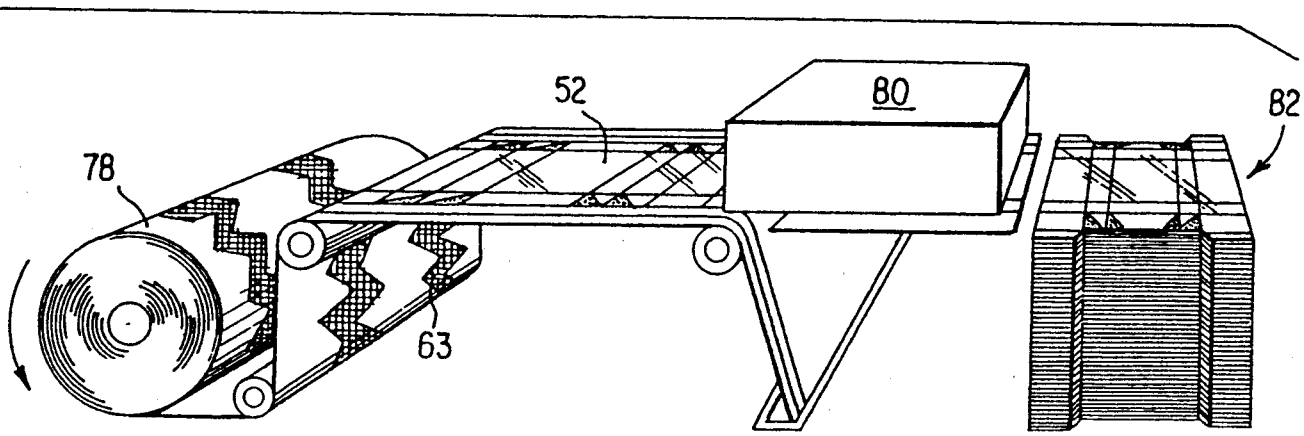
FIG. 5 is a partially schematic perspective illustrating the formation of individual carton blanks from a roll.

Turning now to FIG. 5, web 78 of FIG. 4 is unwound, passes over rollers, and is die cut by mechanism 80 to form, typically, a stack 82 of the blanks shown at FIG. 2. Mechanism 80 also cuts the longitudinally running edges of barrier layer 52 so as to conform to the outer free edges of the end closure panels. As shown at FIG. 2, the periphery of barrier layer 52 is coincident with the outermost, free edges of the end closure panels. It will be understood that mechanism 80 for die cutting the web and film 52 to form the upper perimeter of the blank of FIG. 2 and its relation to the several rollers is known and forms no part of the invention. A stack 82 is formed by the cut blanks 11.

The steps shown at FIGS. 3 to 5 may be combined into one operation, if desired, to pass from starting roll 60 to finished stack 82.

Figure 6:
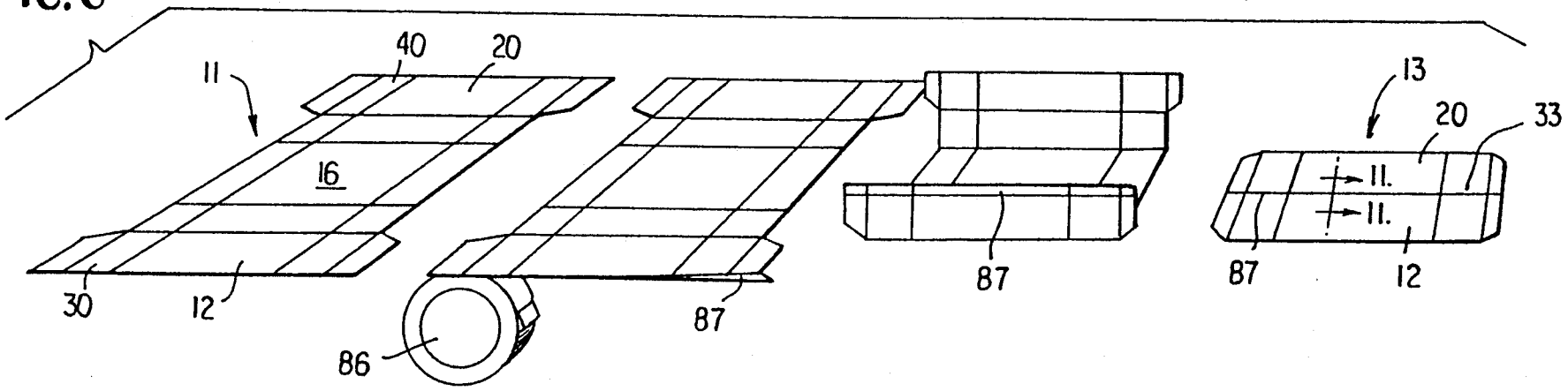
FIG. 6 is a schematic perspective view illustrating the steps skiving a blank edge and folding the blank of FIG. 2 into a flattened, seamed tube configuration, ready for opening and filling by a packager of products, such as granular food products.

Referring now to FIG. 6, a typical blank 11 is illustrated. By virtue of automatic machinery designated generally as 86, an exposed paperboard side edge 87 of each blank is skived and hemmed, such apparatus being known and forming no part of the invention. Blank 11 is translated from left to right and is folded and glued (by known apparatus, not shown) to form a flattened tube designated as 13 at the right of FIG. 6, with the right and left edges of panels 20 and 12 overlapped and glued to form a seam 33. Skived and hemmed edge 87 is in the flattened carton interior, while the other seam forming side edge of the blank is on the outside of the carton and does not come in contact with the carton contents and hence does not require skiving. Such skiving and hemming of the edge of a paperboard blank is known. FIG. 11 shows the seam construction, with overlapped portions of barrier layer 52 in surface contact and bonded together upon seam formation, as is known. The barrier layer coated surface is the carton interior surface.

FIGS. 7 to 10 illustrate the steps in closing the end of a filled container. A flattened container 13 of FIG. 6 is opened, i.e., squared up, and the bottom panels closed and product placed into the open or top end of the container. The container bottom is preferably sealed using the same method for closing and sealing the upper or top of the container, the latter now to be described.

The upper closure forming panels are coplanar with the side and end wall panels from which they extend and are foldably joined, with polymer barrier layer 52 spanning gaps 46 and 48 between the adjacent vertical edges of the upper closure panels, as shown at FIG. 7. Panels 30, 40, joined by seam 33, define a major inner closure panel which is folded inwardly about its fold line 26 until sealing flaps 32, 42 abut the barrier layer coated interior surface of panel 36 in surface to surface contact, the latter flaps folding about lines 27 as shown at FIG. 8. Panels 30, 40 carry a portion of barrier layer or sheet 52, thus pulling down on that sheet portion 52 which originally covered triangular abhesive portions 56 of end wall closure panels 34 and 38, shown at FIG. 8, and peels away these portions from the nonstick abhesive areas 56.

Prior to the closing step of FIG. 8 the filled container may be purged with an inert gas, as is known, and which forms no part of this invention.

Next, end wall closure panels 34 and 38 are folded inwardly about their respective fold lines 26 until these panels come in surface to surface contact with respective horizontal major closure flap panels 30, 40, as shown at FIG. 9. This latter folding causes barrier layer 52 on major closure panel 36 to peel away from abhesive regions 58 of panel 36. Except for the peeled away triangular regions, all surfaces of barrier layer 52 remain in extruded or laminated bonding contact with the interior surfaces of paperboard blank 10 during these folding steps.

Upstanding outer major closure panel 36 is now subject to heat and pressure so as to both bond flap 42, 32 to a portion of the barrier layer coated interior surface of panel 36 and to bond those folded over triangular barrier layer sections 52, formerly covering abhesive coated regions 56, to the barrier layer 52 on major panel 36, with the lower portions of these triangular sections 52 from panels 34 and 38 bonded to respective portions of flaps 42, 32. This sealing may be performed on outer major closure panel 36 in its vertical position shown at FIG. 9, or alternatively, panel 36 may be bent back about its fold line 26 about 90 degrees to the left and then sealed. The major critical seal area is just above score or fold line 27. All folded, gusseted polymer layers 52 and paperboard areas 30, 40, 42, 36 are sealed together in this area creating an hermetic closure. The seal is generally not wider than panels 32, 42. It is seen that the ends of flaps 32, 42 are sandwiched by the barrier film.

Referring now to FIG. 10, the interior surface of outer major closure panel 36 has been provided with a strip of hot melt or other adhesive (not shown) across its length, and panel 36 folded down to thus complete end container closing and sealing sequence. The hot melt adhesive may or may not adhere to abhesive regions 56, but will adhere to portions 58 of major closure panel 36.

The same end sealing and closure steps may be carrier out if the blank 11 is defined by only four main wall forming flaps (instead of the five illustrated) and a conventional interior manufacturer's flap running along an outer edge of one of them. In such a construction, the manufacturer's flap may be hemmed and skived.

Gas barrier layer 52 may be of any known composition and structure. If both sides of the paperboard blank 10 are coated with PE (polyethylene), the resultant laminate layers are, typically, PE/paperboard/tie or adhesive layer/EVOH or foil or nylon/tie or adhesive layer/PE. Thus, the gas barrier layer itself is EVOH or foil or nylon.

We claim:

1. A unitary blank of paperboard having a plurality of wall panels and end closure panels defined by vertically and horizontally extending fold lines, at least four of said wall panels arranged in serial, side by side relation and coupled through said vertical fold lines, said end closure panels pivotally connected by said horizontal fold lines to respective upper and lower edges of respective of said wall panels, a gas impermeable, barrier layer extruded or laminated on one surface of said paperboard blank, gaps between said end closure panels, portions of some of said end closure panels being coated with an abhesive on that surface of said paperboard blank carrying said barrier layer, said abhesive located between said blank and said barrier layer.

2. The blank of claim 1 wherein said barrier layer spans said gaps.

3. The blank of claim 2 wherein said end closure panels include an outer and an inner major closure panel and two minor closure panels, said abhesive being applied to a portion of each of said minor closure panels, said abhesive being applied to end portions of said major closure panels.

4. The blank of claim 3 wherein said abhesive patterns are triangular.

5. A folding carton construction including, a unitary blank of paperboard cut and scored and fashioned into a tube structure having two side and two end wall panels, said tube having two ends, at least one said end of said tube having end closure panels each foldably secured to a respective side and end wall panel of said carton, one of said end closure panels being an inner major end closure panel at least substantially spanning and closing a respective said end of said tube, said inner major closure panel having a sealing flap at an end thereof, another of said end closure panels being an outer major end closure panel foldably connected to a respective said side wall panel of said carton and having an inner surface to which said sealing flap of said inner major closure panel is secured in surface to surface contact, each of said end wall closure panels folded down upon said inner major end closure panel, said outer major closure panel folded down upon said end wall closure panels, said carton having an interior surface, said carton interior surface, said inner major closure panel, and said sealing flap completely covered by a gas barrier layer, said end wall closure panels and said outer major closure panel partially covered by said gas barrier layer, portions of said end wall closure panels and portions of said outer major closure panel coated with an abhesive, said abhesive located between said blank and said barrier layer.

6. The carton construction of claim 5 wherein respective portions of said barrier layer are sandwiched between respective portions of said inner major end closure panel and said end wall closure panels.

7. The carton construction of claim 6 wherein a portion of said sealing flap is sandwiched by said barrier layer.

8. A rectangular tube type paperboard carton having ends and having an interior surface and having two opposite side wall panels and two opposite end wall panels, at least one said end of said carton provided with end closure panels having interior surfaces said end closure panels including inner and outer opposite major end closure panels each foldably connected to a respective side wall panel, first and second end wall closure panels each foldably connected to a respective said end wall panel, said end wall closure panels having side edges, gaps between adjacent said side edges of said end closure panels, a continuous barrier polymer layer laminated to or extruded upon said interior surfaces of said side walls and said end walls and said interior surfaces of said end closure panels and said inner and outer major end closure panels, said barrier polymer layer spanning said gaps, said inner major end closure carrying a sealing flap, said interior surfaces of said end wall closure panels each having a triangular abhesive area thereon, the ends of said outer major end closure panel each having a triangular abhesive area.

9. The carbon of claim 8 wherein the width of said major end closure panels is substantially equal to the width of said end wall panels.

* * * * *